US009683179B2

(12) United States Patent
Holmgreen et al.

(10) Patent No.: US 9,683,179 B2
(45) Date of Patent: Jun. 20, 2017

(54) CATALYTIC REFORMING PROCESSES

(71) Applicant: UOP LLC, Des Plaines, IL (US)

(72) Inventors: Erik Holmgreen, Racine, WI (US); Lin Jin, Des Plaines, IL (US); Mark P. Lapinski, Aurora, IL (US); Brian M. Devereux, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/178,412

(22) Filed: Jun. 9, 2016

(65) Prior Publication Data

US 2016/0369179 A1 Dec. 22, 2016

Related U.S. Application Data

(60) Provisional application No. 62/180,335, filed on Jun. 16, 2015.

(51) Int. Cl.

| | |
|---|---|
| ***C10G 35/24*** | (2006.01) |
| ***C10G 35/04*** | (2006.01) |
| ***C10G 59/02*** | (2006.01) |

(52) U.S. Cl.

CPC ..... *C10G 35/04* (2013.01); *C10G 59/02* (2013.01); *C10G 2300/80* (2013.01); *C10G 2400/30* (2013.01)

(58) Field of Classification Search

CPC ..... C10G 35/04; C10G 35/24

USPC ..... 208/133, 134, 141

See application file for complete search history.

(56) References Cited

U.S. PATENT DOCUMENTS

| | | | |
|---|---|---|---|
| 4,146,465 | A | 3/1979 | Blazek, Sr. et al. |
| 2002/0007595 | A1* | 1/2002 | Maier-Roeltgen ..... B01B 1/005 48/116 |
| 2012/0277500 | A1 | 11/2012 | Moser et al. |
| 2012/0277511 | A1 | 11/2012 | Moser et al. |
| 2013/0158311 | A1 | 6/2013 | Serban et al. |
| 2013/0158320 | A1 | 6/2013 | Moser et al. |

* cited by examiner

*Primary Examiner* — Thuan D Dang

(57) ABSTRACT

Processes for catalytic reforming in which a cracking inhibitor, such as an olefin, or a light olefin, is used to inhibit thermal cracking of larger hydrocarbons in non-reactive zones. The cracking inhibitor may be added at various positions through the processes, such as in the recycle gas stream, before a heater, before a stream is passed into a reforming zone, after an effluent stream is recovered from a reforming zone. A molar ratio of cracking inhibitor to hydrocarbons in stream may be between 0.01 and 0.2.

4 Claims, 1 Drawing Sheet

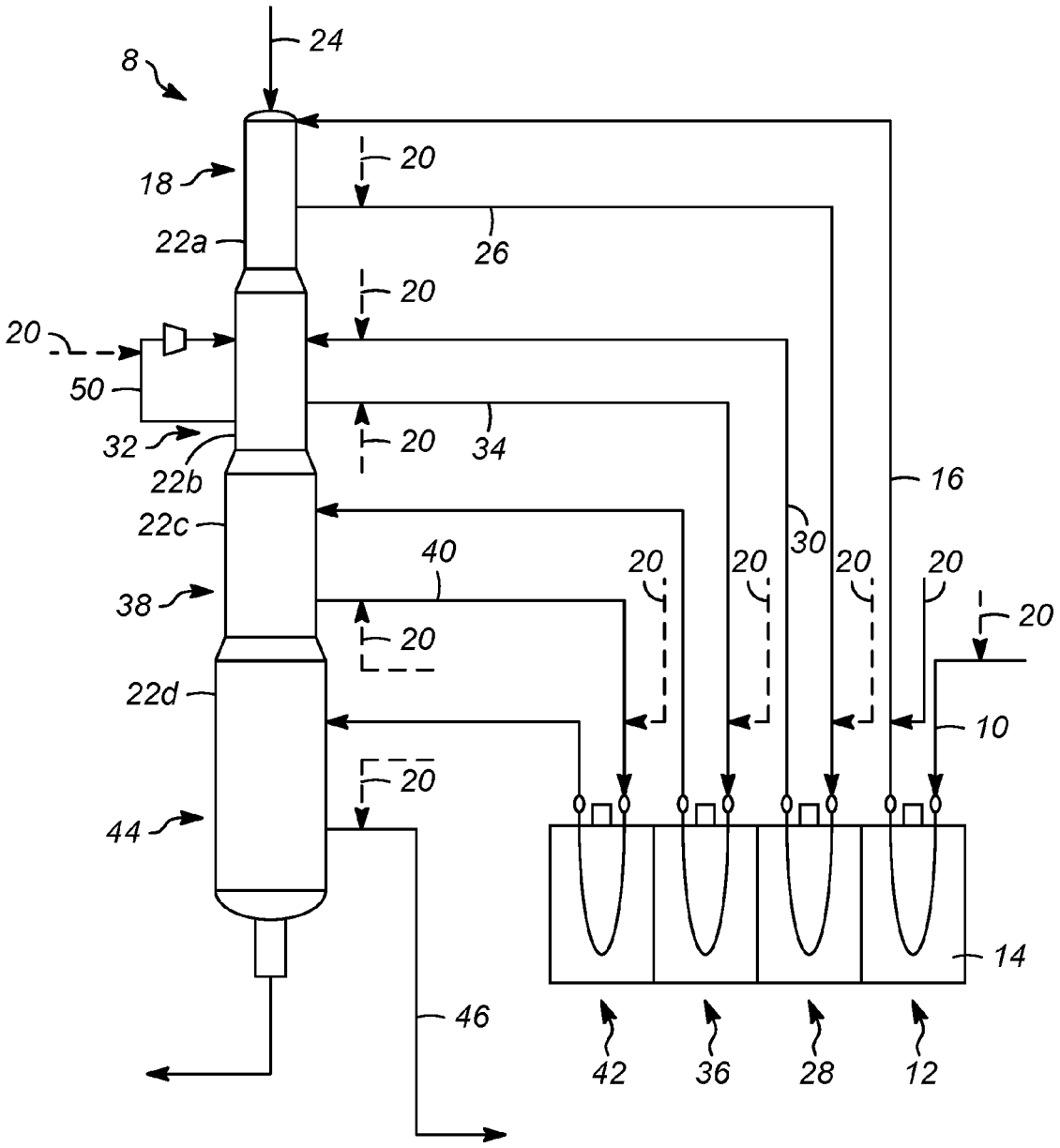
24
8
18
20
22a
26
20
20
50
32
22b
20
34
16
22c
30
40
20
20
20
20
38
20
20
22d
10
20
44
14
46
42
36
28
12

CATALYTIC REFORMING PROCESSES

CROSS-REFERENCE TO RELATED APPLICATION

This application claims priority from Provisional Application No. 62/180,335 filed Jun. 16, 2015, the contents of which are hereby incorporated by reference.

FIELD OF THE INVENTION

This invention relates generally to processes for the production of aromatic compounds, and in particular processes in which include a catalyst for reforming hydrocarbons to form aromatic compounds such as benzene, toluene and xylenes from a naphtha feedstream through changing process conditions.

BACKGROUND OF THE INVENTION

The reforming of petroleum raw materials is an important process for producing useful products. One important process is the separation and upgrading of hydrocarbons for a motor fuel, such as producing a naphtha feedstream and upgrading the octane value of the naphtha in the production of gasoline. However, hydrocarbon feedstreams from a raw petroleum source include the production of useful chemical precursors for use in the production of plastics, detergents and other products.

The upgrading of gasoline is an important process, and improvements for the conversion of naphtha feedstreams to increase the octane number have been presented in U.S. Pat. Nos. 3,729,409, 3,753,891, 3,767,568, 4,839,024, 4,882,040 and 5,242,576. These processes involve a variety of means to enhance octane number, and particularly for enhancing the aromatic content of gasoline.

Processes include splitting feeds and operating several reformers using different catalysts, such as a monometallic catalyst or a non-acidic catalyst for lower boiling point hydrocarbons and bi-metallic catalysts for higher boiling point hydrocarbons. Other improvements include newer catalysts, as presented in U.S. Pat. Nos. 4,677,094, 6,809,061 and 7,799,729. However, there are limits to the methods and catalysts presented in these patents, and which can entail significant increases in costs.

In general, high operating temperatures are preferred for operating a reformer, as the equilibriums at the higher temperatures favors the formation of aromatic compounds. However, the reforming process is operated at a lower temperature due to the thermal cracking and the metal catalyzed coking that occurs as the temperature is increased. Recent advances however have provided advances that allow for the reforming reactions to be done at increased temperatures. For example, as disclosed U.S. Pat. Pub. No. 2012/0277500, the entirety of which is incorporated herein by reference, it has been found that using reactor vessels with non-metallic coatings allow for higher temperature operations, without the accompanying increase in coking or thermal cracking.

Increasing the temperature would normally be a preferred condition, since the higher temperatures shift the equilibriums of the reforming reactions to favor the production of aromatics. However, increasing the temperatures increases the formation of coke on the catalyst, and more rapidly deactivates the catalyst. This in turn requires more energy to regenerate the catalyst on a more frequent basis. Increasing temperatures also increases thermal cracking for the heavier hydrocarbons, and can start or increase metal catalyzed coking on the surfaces of the reactor vessel or piping used to transport the hydrocarbons to the reformer. The thermal cracking of naphtha feed and intra-reactor reformed product streams lead directly to yield loss through the production of light (one to four carbon) hydrocarbons.

Some reforming processes utilize flow schemes in which high-temperature, short residence time reactors favor ring closure over catalytic cracking and dealkylation reactions. While catalytically beneficial this design also requires increased temperatures in heaters and transfer lines to the terminal reactors giving corresponding increases in thermal cracking yield losses. Although thermal cracking exists in all reforming units the potential for yield loss is potentially higher in such designs due to the elevated temperatures intrinsically required by the process.

Therefore, there remains a need for an effective and efficient process for minimizing the amount of thermal cracking of hydrocarbons in a reforming reaction.

SUMMARY OF THE INVENTION

One or more process have been invented, in which a thermal cracking inhibitor, preferably an olefin stream, and most preferably a light olefin stream, is mixed with a stream in a catalytic reformer unit. The thermal cracking inhibitor will reduce the amount of thermal cracking of C5+ hydrocarbons, and thus, minimize the yield loss of that may occur as a result the thermal cracking.

Therefore, in a first embodiment of the invention, the present invention may be broadly characterized as providing a process for reducing the thermal cracking in a catalytic reforming unit by: heating a feed stream comprising a hydrocarbons to provide a heated feed stream; reforming the hydrocarbons in the heated feed stream in a reforming zone, the reforming zone having catalyst and being configured to provide a reformate effluent stream; and, reducing thermal cracking of the hydrocarbons by mixing a cracking inhibitor with at least one of the feed stream, the heated feed stream, and the reformate effluent stream.

In various embodiments of the present invention, the cracking inhibitor comprises an olefin stream. It is contemplated that the olefin stream comprises light olefins.

In one or more embodiments of the present invention, a molar ratio of cracking inhibitor to hydrocarbons in the heated feed stream is between 0.01 and 0.2. It is contemplated that a molar ratio of cracking inhibitor to hydrocarbons in the reformate effluent stream is between 0.01 and 0.2.

In at least one embodiment of the present invention, a molar ratio of cracking inhibitor to hydrocarbons in the reformate effluent stream is between 0.01 and 0.2.

In some embodiments of the present invention, the process further includes reducing thermal cracking of the hydrocarbons by mixing the cracking inhibitor with the reformate effluent stream and the feed stream.

In at least one embodiment of the present invention, the process includes reducing thermal cracking of the hydrocarbons by mixing the cracking inhibitor with the reformate effluent stream and the heated feed stream.

In various embodiments of the present invention, the process further includes reforming the hydrocarbons in the reformate effluent stream in a second reforming zone, the second reforming zone having catalyst and being configured to provide a second reformate effluent stream, wherein the reformate effluent stream is mixed with the cracking inhibitor. It is contemplated that the process further includes reducing thermal cracking of the hydrocarbons in the second reformate effluent stream by mixing the second reformate effluent stream with the cracking inhibitor.

In a second aspect of the present invention, the present invention may be generally characterized as providing a process for reducing the thermal cracking in a catalytic reforming unit by: heating a feed stream comprising hydrocarbons in a first heating zone and passing the feed stream from the first heating zone to a first reforming zone; mixing the feed stream with a cracking inhibitor before the feed stream is passed to the first reforming zone; reforming the hydrocarbons in the feed stream in the first reforming zone, the reforming zone having catalyst and being configured to provide a reformate effluent stream; recovering the reformate effluent stream from the first reforming zone; passing the reformate effluent stream to a second heating zone and heating the reformate effluent stream in the second heating zone; passing the reformate effluent stream from the second heating zone to a second reforming zone; and reforming the hydrocarbons in the reformate effluent stream in the second reforming zone, the second reforming zone having catalyst and being configured to provide a second reformate effluent stream.

In some embodiments of the present invention, the process further includes mixing the reformate effluent stream with a cracking inhibitor before the reformate effluent stream is passed to the second reforming zone. It is contemplated that process includes mixing the second reformate effluent stream with a cracking inhibitor. It is also contemplated that a molar ratio of cracking inhibitor to hydrocarbons in the feed stream is between 0.01 and 0.2.

In various embodiments of the present invention, the cracking inhibitor comprises light olefins. It is contemplated that a molar ratio of light olefins to hydrocarbons in the feed stream is between 0.01 and 0.2.

In a third aspect of the invention, the present invention may be broadly characterized as providing a process for reducing the thermal cracking in a catalytic reforming unit by: heating a feed stream comprising hydrocarbons in a first heating zone and passing the feed stream from the first heating zone to a first reforming zone; reforming the hydrocarbons in the feed stream in the first reforming zone, the reforming zone having catalyst and being configured to provide a reformate effluent stream; recovering the reformate effluent stream from the first reforming zone; mixing the reformate effluent stream with a light olefin stream before the reformate effluent stream is passed to a second reforming zone, wherein a molar ratio of light olefins to hydrocarbons in the reformate effluent stream is between 0.01 and 0.2; passing the reformate effluent stream to the second heating zone and heating the reformate effluent stream in the second heating zone; passing the reformate effluent stream from the second heating zone to a second reforming zone; and, reforming the hydrocarbons in the reformate effluent stream in the second reforming zone, the second reforming zone having catalyst and being configured to provide a second reformate effluent stream.

In one or more embodiments of the present invention, the process further includes mixing the feed stream with a light olefins stream before the feed stream is passed to the first reforming zone. It is contemplated that a molar ratio of light olefins to hydrocarbons in the feed stream is between 0.01 and 0.2. It is also contemplated that the process further includes mixing the second reformate effluent stream with a light olefins stream.

Additional aspects, embodiments, and details of the invention, all of which may be combinable in any manner, are set forth in the following detailed description of the invention.

BRIEF DESCRIPTION OF THE DRAWING

One or more exemplary embodiments of the present invention will be described below in conjunction with the following drawing FIGURE, in which:

The FIGURE shows an exemplary catalyst reformer reactor system that may be used in association with one or more embodiments of the present invention.

DETAILED DESCRIPTION OF THE INVENTION

As mentioned above, one or more processes have been invented to reduce the amount of thermal cracking associated with a catalytic reformer unit. Thermal cracking of hydrocarbons proceeds through a unimolecular reaction in which a hydrogen is abstracted from the hydrocarbon to produce a radical species, followed by carbon-carbon bond breaking in the position beta to the formed radical. The primary factors influencing the thermal cracking rate, and thus yield loss, are temperature and residence time at elevated temperatures. The cracking rate is also a function of the molecule's carbon number, as well as attached functional groups such branches, double bonds, and phenyl groups. It is believed that olefins, preferably light olefins may be used as a thermal cracking inhibitor in the catalytic reformer unit.

This inhibition of thermal cracking is due to the ability of, for example, propylene to form a stable radical species. The formed allylic radical is stabilized by the presence of the nearby double bond and thus eventually undergoes a termination reaction rather than cracking and further radical formation. Not only is the propylene molecule less subject to cracking, but by stabilizing radical species it inhibits the rate of propane thermal cracking.

With these general principles in mind, one or more embodiments of the present invention will be described with the understanding that the following description is not intended to be limiting.

Various processes of the present invention utilize a catalytic reforming unit, such as the catalytic reforming unit 8 shown in the FIGURE. As depicted, a feed stream 10 comprising hydrocarbons, preferably naphtha range hydrocarbons, i.e., C5 to C12 hydrocarbons, is passed to a heating zone 12 having a charge heater 14 or other heating device. In the heating zone 12, the temperature of the feed stream 10 is increased to provide a heated feed stream 16. The heated feed stream 16 is passed to a reforming zone 18.

In this application, hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., C3+or C3−, which is inclusive of the abbreviated one or more hydrocarbons. As an example, the abbreviation "C3+" means one or more hydrocarbon molecules of three carbon atoms and/or more.

Returning to the FIGURE, as the temperature of the hydrocarbons in the feed stream 10 increases in the heating zone 12, it is possible that thermal cracking of the hydrocarbons occurs. The thermal cracking of the larger hydrocarbons (ones that are suitable for reforming into aromatic and naphthenic hydrocarbons) into lower value, smaller hydrocarbons is undesirable. Accordingly, as shown in the FIGURE, a cracking inhibitor 20 is mixed with the heated feed stream 16. As shown in dashed lines, the cracking inhibitor 20 may also be mixed with the feed stream 10, before it is heated in the heating zone 12.

As mentioned above, a preferred cracking inhibitor 20 comprises olefins, and most preferably the cracking inhibitor comprises light olefins or C2 to C4 olefins. The light olefins may be in a hydrocarbon stream having other components as well. A molar ratio of cracking inhibitor 20 to hydrocarbons in the feed stream 10, in the heated feed stream 16, or in both may be between 0.01 and 0.2. The presence of the cracking inhibitor 20 will minimize or reduce the amount of thermal cracking that is occurring in the non-reaction zones, i.e., those portions of the catalytic reforming unit 8 in which the cracking of hydrocarbons is not intended to occur, such as the transfer pipes, heaters, and other zones.

Returning to the FIGURE, the reforming zone 18 may comprise a reactor 22*a* on a stack of a plurality of reactors 22*a*, 22*b*, 22*c*, 22*d*, such as depicted in the FIGURE. The reactor 22*a* in the reforming zone 18 can comprise any suitable reactor design known in the art. For example, the reforming process is an endothermic process, and to maintain the reaction, the reformer is a catalytic reactor that can comprise a plurality of reactor beds with interbed heaters. The reactor beds are sized with the interbed heaters to maintain the temperature of the reaction in the reactors. A relatively large reactor bed will experience a significant temperature drop, and can have adverse consequences on the reactions. The catalyst can also pass through inter-reformer heaters to bring the catalyst up to the desired reformer inlet temperatures. The interbed heaters reheat the catalyst and the process stream as the catalyst and process stream flow from one reactor bed to a sequential reactor bed within the reformer. The most common type of interbed heater is a fired heater that heats the fluid and catalyst flowing in tubes. Other heat exchangers can be used.

The reforming process is a common process in the refining of petroleum and comprises mixing a stream of hydrogen, a hydrocarbon mixture and, a reforming catalyst 24. The usual feedstock is a naphtha feedstock and generally has an initial boiling point of about 80° C. (176° F.) and an end boiling point of about 205° C. (401° F.). The reforming reactors 22*a*, 22*b* 22*c*, 22*d* may be operated with a feed inlet temperature between 440 and 580° C. (824 and 1076° F.), or between 500 and 580° C. (932 and 1076° F.), or between 540 and 580 ° C. (1004 and 1076° F.), or at least above 540° C. (932° F.). The reforming reactors 22*a*, 22*b* 22*c*, 22*d* may have different operating temperatures, for example, with a first reforming reactor having a temperature between 500 to 540° C. (932 to 1004° F.) and a second, subsequent reforming reactor having a temperature greater than 540° C. (1004° F.). The reaction conditions also include a liquid hour space velocity (LHSV) in the range from 0.6 $hr^{-1}$ to 10 $hr^{-1}$. Preferably, the LHSV is between 0.6 $hr^{-1}$ and 5 $hr^{-1}$, with a more preferred value between 1 $hr^{-1}$ and 5 $hr^{-1}$, and with a most preferred value between 2 $hr^{-1}$ and 5 $hr^{-1}$. The shorter residence time is especially preferred when utilizing the higher temperatures. The catalyst also has a residence time in the reforming reactors 22*a*, 22*b* 22*c*, 22*d* between 0.5 hours and 36 hours. The reforming reaction converts paraffins and naphthenes through dehydrogenation and cyclization to aromatics. The dehydrogenation of paraffins can yield olefins, and the dehydrocyclization of paraffins and olefins can yield aromatics.

Reforming catalysts generally comprise a metal on a support. The support can include a porous material, such as an inorganic oxide or a molecular sieve, and a binder with a weight ratio from 1:99 to 99:1. The weight ratio is preferably from about 1:9 to about 9:1. Inorganic oxides used for support include, but are not limited to, alumina, magnesia, titania, zirconia, chromia, zinc oxide, thoria, boria, ceramic, porcelain, bauxite, silica, silica-alumina, silicon carbide, clays, crystalline zeolitic aluminasilicates, and mixtures thereof. Porous materials and binders are known in the art and are not presented in detail here. The metals preferably are one or more Group VIII noble metals, and include platinum, iridium, rhodium, and palladium. Typically, the catalyst contains an amount of the metal from about 0.01% to about 2% by weight, based on the total weight of the catalyst. The catalyst can also include a promoter element from Group IIIA or Group IVA. These metals include gallium, germanium, indium, tin, thallium and lead.

Accordingly, as shown in the FIGURE, an effluent stream 26 comprising a reformate effluent stream may be withdrawn from the reforming zone 18 and passed to a second heating zone 28. As shown in the FIGURE, at this point, there is still unconverted hydrocarbons in the reformate effluent stream 26, accordingly, the cracking inhibitor 20 may be mixed with the reformate effluent stream 26 for example as it is withdrawn from the reforming zone 18, or before it is passed to the second heating zone 28, or both. A preferred molar ratio of cracking inhibitor to hydrocarbons is between 0.01 and 0.2.

In the second heating zone 28, the reformate effluent stream 26 will be heated to provide a heated effluent stream 30 which is passed to a second reforming zone 32. In this manner, any effluent stream that is passed into a subsequent reforming zone is considered a feed stream for that subsequent reforming zone. The heated effluent stream 30 may be mixed with cracking inhibitor 20 before passing into the second reforming zone 32. The second reforming zone 32 is preferably operated similarly, but at a higher temperature, than that first reforming zone 18. This is merely preferred.

From the second reforming zone 32, a second reformate effluent stream 34 may be passed to a third heating zone 36 to be heated and form a heated effluent stream which is passed to a third reforming zone 38. From the third reforming zone 38, a third reformate effluent stream 40 may be passed to a fourth heating zone 42 to be heated and form a heated effluent stream which is passed to a fourth reforming zone 44. From the fourth reforming zone 44, a net reformate effluent 46 may be passed to a separation zone (not shown) to separate the components of the net reformate effluent 46 as is known in the art. The number of reforming zones 18, 32, 38, 44 and particular configuration of same are not necessary for the practicing and understanding of the present invention.

It should be appreciated, that at various locations in the processing of the feed stream 10, the heat feed stream 16, the heat effluent streams, and the effluent streams 26, 34, 40, 46, the cracking inhibitor 20 may be introduced and mixed with the hydrocarbon stream(s). Thus, while only particular positions of introduction of the cracking inhibitor 20 may have been discussed above or shown in the FIGURE, it is specifically contemplated that the cracking inhibitor 20 is mixed with a hydrocarbon stream at any number of various locations in the process. Thus, the particular location of the introduction of cracking inhibitor 20 is not intended to be limiting.

For example, in some embodiments, due to cost, only the feed stream 10 and the first reformate effluent 26 may be mixed with the cracking inhibitor 20. Alternatively, all of the reformate effluent streams 26, 34, 40, 46 may be mixed with the cracking inhibitor 20. In at least one embodiment, the cracking inhibitor 20 may be mixed with a recycle gas stream 50 that is passed into one or more of the reforming zones 18, 32, 38, 44. One of ordinary skill in the art will appreciate the different possibilities and combinations for introducing the cracking inhibitor 20 with the hydrocarbons to inhibit the thermal cracking in the various non-reaction zones of the unit.

In order to demonstrate the principles of the present invention, a series of process simulations were performed using the kinetic models for thermal cracking and naphtha reforming. A conventional reforming process was simulated at high severity (approximately 549° C. (1020° F.)) with a total hot residence time for the thermal cracking zones of approximately 10 seconds. For these conditions the total C5+ yield loss due to thermal cracking was about 2.5 wt %. The C5+ yield was then calculated for cases where varying amounts of light olefins were added to the first two reaction zones. The full results are summarized in the below TABLE.

TABLE

| | Sim 1 | Sim 2 | Sim 3 | Sim 4 | Sim 5 | Sim 6 | Sim 7 |
|---|---|---|---|---|---|---|---|
| React. Zn. 1 (C2-C4)=/ HC Molar Ratio | 0.00 | 0.05 | 0.10 | 0.15 | 0.15 | 0.15 | 0.15 |
| React. Zn. (C2-C4)=/ HC Molar Ratio | 0.00 | 0.00 | 0.00 | 0.00 | 0.05 | 0.10 | 0.15 |
| React. Zn. (Reduced TC Rate)/(Base TC Rate) | 1.000 | 0.601 | 0.464 | 0.464 | 0.462 | 0.461 | 0.459 |
| React. Zn. (Reduced TC Rate)/(Base TC Rate) | 1.000 | 1.000 | 1.000 | 1.000 | 0.783 | 0.616 | 0.478 |
| C5+ Yield Gain | 0.00 | 0.23 | 0.42 | 0.57 | 0.69 | 0.79 | 0.87 |

As shown in the above TABLE, the molar ratio of C2-C4 olefins-to-fresh feed (O/HC ratio) in the first reaction zone was varied from 0.05 to 0.15. Additionally, the molar ratio of C2-C4 olefins-to-fresh feed (O/HC ratio) in the second reaction zone was varied from 0.05 to 0.15.

Based upon the above, the C5+ yield loss reduction varied from 0.23 to 0.57 wt % depending on the various amounts of olefins added into the two reaction zones. Further reductions were predicted when light olefins were also introduced to the second reaction zone.

It is believed that the processes requires amounts of light olefins to suppress thermal cracking that are well in excess of equilibrium concentrations. The olefin concentrations are believed to be reduced to equilibrium levels by the catalyst, and therefore, it is preferred that light olefins, as the cracking inhibitor, are introduced separately before each zone where thermal cracking may be significant. However, the economic viability of the process will depend on the source of light olefins in the refinery or processing plant. Some possible sources of streams having olefins amounts that would inhibit the thermal cracking include Oleflex processing of the PSA tail gas stream from the reforming net gas recovery section, or a mixed olefin stream from a naphtha steam cracker. Other potential sources will be appreciated by those of ordinary skill in the art.

By using the light olefins as a cracking inhibitor, the thermal cracking of the larger hydrocarbons may be reduced. Improving the yield of the reforming reactor in minimal amounts can provide significant increases in production values for refiners and processors.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understanding the embodiments of the present invention.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A process for reducing the thermal cracking in a catalytic reforming unit, the process comprising:

heating a feed stream comprising hydrocarbons in a first heating zone and passing the feed stream from the first heating zone to a first reforming zone;

reforming the hydrocarbons in the feed stream in the first reforming zone, the first reforming zone having catalyst and being configured to provide a reformate effluent stream;

recovering the reformate effluent stream from the first reforming zone;

mixing the reformate effluent stream with a light olefin stream as a cracking inhibitor to reduce thermal cracking of hydrocarbons before the reformate effluent stream is passed to a second reforming zone, wherein a molar ratio of light olefins to hydrocarbons in the reformate effluent stream is between 0.01 and 0.2;

passing the reformate effluent stream to the second heating zone and heating the reformate effluent stream in the second heating zone;

passing the reformate effluent stream from the second heating zone to a second reforming zone; and, reforming the hydrocarbons in the reformate effluent stream in the second reforming zone, the second reforming zone having catalyst and being configured to provide a second reformate effluent stream.

2. The process of claim 1 further comprising:

mixing the feed stream with a light olefins stream before the feed stream is passed to the first reforming zone.

3. The process of claim 2, wherein a molar ratio of light olefins to hydrocarbons in the feed stream is between 0.01 and 0.2.

4. The process of claim 3 further comprising:

mixing the second reformate effluent stream with a light olefins stream.

* * * * *